US007082984B2

(12) United States Patent
Rizzo

(10) Patent No.: US 7,082,984 B2
(45) Date of Patent: Aug. 1, 2006

(54) ARTICLE CASTING METHOD

(75) Inventor: Norberto Rizzo, Edo Carabobo (VE)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 10/903,614

(22) Filed: Jul. 30, 2004

(65) Prior Publication Data

US 2006/0021727 A1 Feb. 2, 2006

(51) Int. Cl.
*B22C 9/00* (2006.01)

(52) U.S. Cl. ..... 164/29; 164/28; 164/30; 164/32; 164/35; 164/45

(58) Field of Classification Search ..... 164/29, 164/28, 30, 32, 35, 45, 237, 244, 340, 207
See application file for complete search history.

(56) References Cited

U.S. PATENT DOCUMENTS 2,951,336 A * 9/1960 Mueller ..... 164/108
3,996,991 A * 12/1976 Ugata et al. ..... 164/35
4,289,191 A * 9/1981 Myllymaki ..... 164/45
4,694,879 A 9/1987 Feuring

* cited by examiner

*Primary Examiner*—Kevin Kerns
*Assistant Examiner*—I.-H. Lin
(74) *Attorney, Agent, or Firm*—Marshall & Melhorn LLC

(57) ABSTRACT

The present invention is a method for casting a part having a complex shape or having a complex shape thereon. The method includes providing a pattern and securing at least one core to the pattern. A conformable material is located about the pattern and the core to create a complementary shape to the pattern and core in the conformable material. The pattern is removed and the core is left behind in the conformable material. The core leaves space, or an empty form, for a negative draw that cannot be formed in known casting methods. A mold is located adjacent the shaped, conformable material. A hardenable material is located between the mold and the shaped, conformable material and into the core. The hardenable material is allowed to harden and then it is removed. A cast part having a complex shape, or having a complex shape integrally formed with the part, results.

20 Claims, 12 Drawing Sheets

ARTICLE CASTING METHOD

FIELD OF THE INVENTION

The present invention relates to a method for casting an article.

BACKGROUND OF THE INVENTION

Methods for casting articles are well known to those skilled in the art. Current attempts to cast an article having a complex shape, however, are not practical. For example, one such known method is described in U.S. Pat. No. 4,694,879. In U.S. Pat. No. 4,694,879, a casting process that uses gasifiable parts located on a reusable part is described. The gasifiable parts are alleged to enable parts to be cast with contours that would otherwise be difficult to produce by known casting methods. The reusable part, with the gasifiable part initially located thereon, is located in a packed sand mold and then removed. The sand takes on the shape of the reusable part and the gasifiable part remains behind in the sand mold. As liquid material is added to the sand mold, it destroys the gasifiable part and fills the void it left behind. The liquid material hardens in a desired shape of the part.

The method described above may be adequate to produce a part with a limited number of non-standard contours, however, the high cost and low efficiency associated with using gasifiable parts is likely prohibitive for large scale production. Furthermore, the above-described process may be limited in shapes and the types of parts that can be produced.

Other than the method described above, the known casting methods are disadvantageous since they are limited to relatively simple shapes and designs for the parts. This is primarily because those skilled in the art know that, in a parting line system, the mold impression of a complex shape having a negative draw will crumble when it is unsupported. The crumbled mold impression cannot be used later in the process.

In light of the disadvantages in the prior art, it would be advantageous to have a method for casting complexly shaped parts having a negative draw, or parts having a complex shape associated with them, in a cost effective and efficient manner.

SUMMARY OF THE INVENTION

The present invention is directed toward an article casting process where at least one pattern is provided having at least one core secured to the pattern. Preferably, the core is a negative draw design, as known to those skilled in the art. A conformable material is located about the core and the pattern to form the material into a complementary shape to the core and pattern. The pattern is then removed from the conformable material and the core is retained as part of the mold impression. A hardenable material is located within the core to form at least a portion of a complex shape for a part.

BRIEF DESCRIPTION OF THE DRAWINGS

The above, as well as other advantages of the present invention, will become readily apparent to those skilled in the art from the following detailed description when considered in the light of the accompanying drawings in which.

DETAILED DESCRIPTION OF THE PREFERRED EMBODIMENTS

It is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions, directions or other physical characteristics relating to the embodiments disclosed are not to be considered as limiting, unless the claims expressly state otherwise.

Figure 1:
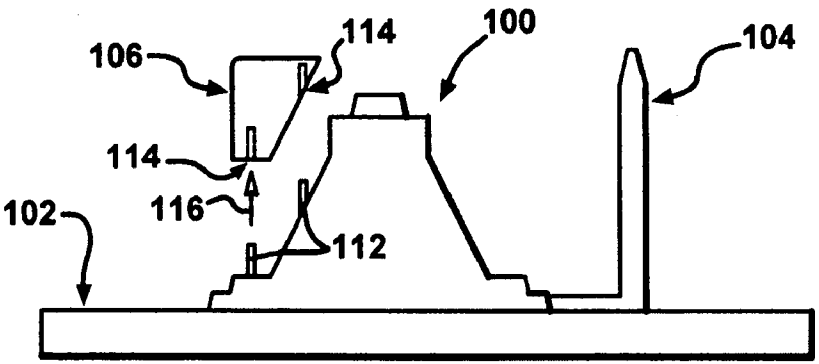
FIG. 1 is a schematic side view of one embodiment of a first pattern of the present invention.

FIG. 1 depicts a pattern, or cope 100, located on a cope base 102. FIG. 1 only illustrates one embodiment of the cope 100. Those skilled in the art will appreciate that copes of various sizes and shapes other than that depicted in FIG. 1 may be used with the present invention. The cope 100 shown in FIG. 1 is designed to have a complementary shape to at least a portion of the part that will be cast. A sprue 104 is depicted as extending from the cope 100. The sprue 104 may be of any shape or size and may extend from the cope 100 at other locations than that depicted in FIG. 1.

Figure 2:
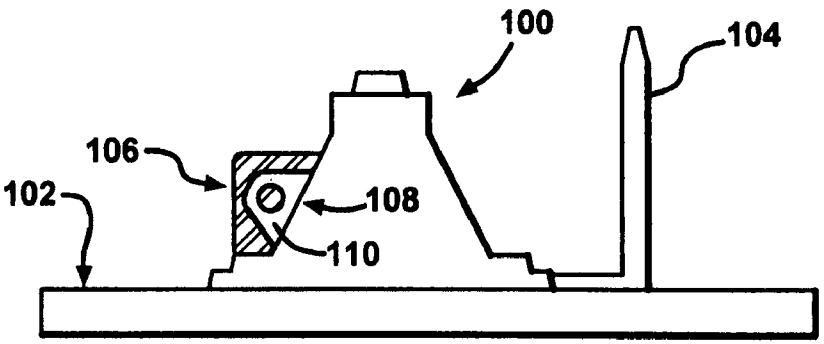
FIG. 2 is a schematic side view of the invention depicted in FIG. 1 with one embodiment of a core on the first pattern.

FIG. 2 depicts a core 106 attached to one portion of the cope 100. The core 106 may be of any shape or size and may be located on any portion of the cope 100. In this embodiment, the core 106 is attached to a side portion 108 of the cope 100. Preferably, at least a portion 110 of the core 106 is hollow to accept a hardenable material in a negative draw process, as known to those skilled in the art. The hollow portion 110 of the core 106 has a complementary shape to a shape that is desired to be included with the cast part.

The hollow portion 110 may be comprised of one or more curvilinear shapes, such as convex, concave and/or compound curves, although any design is within the scope of the present invention. The curvilinear shapes of the core 106 are used to integrally form complementary shaped structures with the part that cannot be created during a typical casting process, hereinafter inclusively called complex shapes, because of the negative draw design.

Although only one core 106 is depicted as attached to one portion 108 of the cope 100, those skilled in the art will appreciate that additional cores of the same, or differing shapes and sizes, may be attached. Those skilled in the art will also appreciate that one or more cores may be attached to a drag. A drag is described in more detail below.

The core 106, or cores 106 as the case may be, may be constructed of a variety of materials. In a preferred embodiment, the core is constructed of one or more a resinous materials. By way of example only, a phenolic resin and a polyisocianate resin are combined to form a material for the core. The mixed resins may be hardened with a catalyst, such as an amine. Those skilled in the art will appreciate that there are other ways to create core, such as shell molding, hot box processes and carbon dioxide processes, that are well within the scope of the present invention.

Referring back to FIG. 1, the core 106 is preferably attached to the cope 100 with one or more pins 112. The pins 112 extend from the cope 100 and fit within complementary shaped recesses 114 in the core 106. The pins 112 are designed and positioned to allow the core 106 to slide off the cope 100 in only a single direction. In the preferred embodiment depicted in the figures, the pins 112 are designed and positioned to allow the core 106 to slide off the cope 100 in a generally vertical direction only as shown by the arrow 116. The pins 112 resist, or prevent, movement of the core 106 with respect to the cope 100 in any other direction.

Those skilled in the art will appreciate that other devices and processes other than the pins 112 described above may be used to selectively secure the core 106 to the cope 100 for any parting line. The core 106 may also be secured to the cope 100 by one or more mechanical fasteners, mechanical or fluid driven clamps, pins that expand and contract either mechanically or via fluid means, vacuum, magnets and/or any other structure known by those skilled in the art.

It is also well within the scope of the present invention to not use any devices to secure the core 106 to the cope 100. In this embodiment, the core 106 is designed with a fit that precisely complements the shape of the cope 100, or drag, as the case may be. The precise complementary shape only allows the core 106 to be removed from the cope 100 in a particular direction, such as vertically, to ensure that it will not be inadvertently removed. The structures and/or processes used to secure the core 106 to the cope 100 will depend on the design of the piece to be cast.

Figure 3:
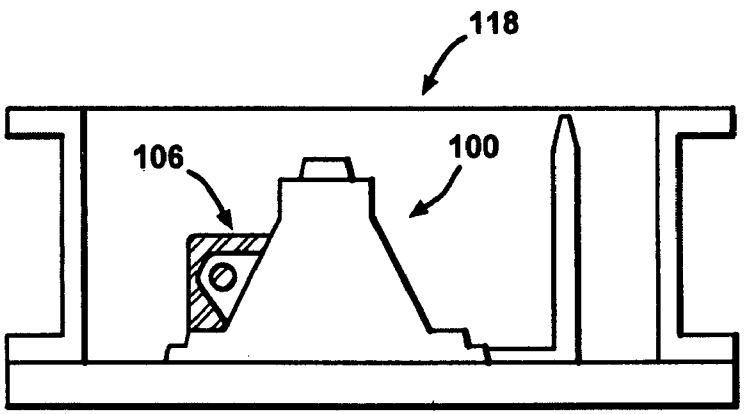
FIG. 3 is a schematic side view of the core and first pattern within a first flask.

As seen in FIG. 3, the cope 100 with the core 106 located thereon is placed in a first flask, or cope flask, 118. The cope 100 and core 106 can be located in the first flask 118 by manual or automated means as known to those skilled in the art. Preferably, the core 106 has been secured to the cope 100 before they are located in the first flask 118, however, the core 106 can be secured to the cope 100 in the first flask 118.

Figure 4:
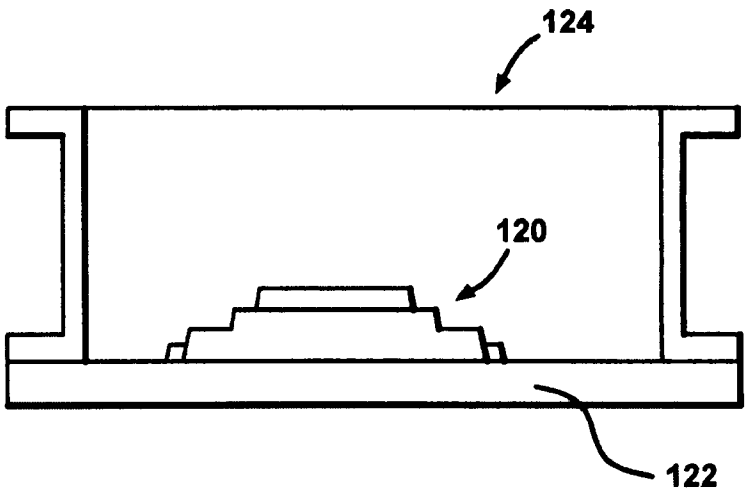
FIG. 4 is a schematic side view of one embodiment of a second pattern within a second flask.

FIG. 4 depicts a pattern, or drag 120, located on a drag base 122 within a second flask, or a drag flask, 124. FIG. 4 only illustrates one embodiment of the drag 120. Those skilled in the art will appreciate that drags of various sizes and shapes other than that depicted in FIG. 4 may be used with the present invention. The drag 120 depicted in FIG. 4 is designed to have a complementary shape to at least a portion of the part that will be cast.

Those skilled in the art will also appreciate that although the preferred embodiment described herein refers to a cope 100 and a drag 120 and a first flask 118 and a second flask 124, the concept of the present invention can be practiced with a single pattern and flask without departing from the scope of the invention.

Figure 6:
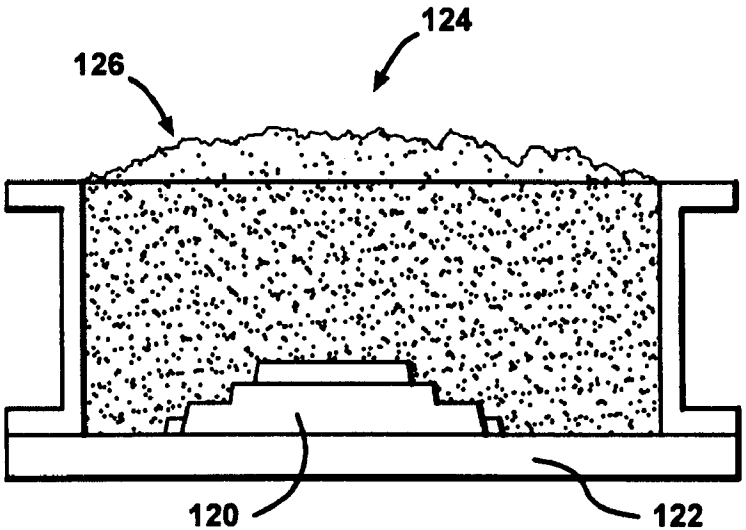
FIG. 6 is a schematic side view of the second flask filled with a conformable material.
Figure 5:
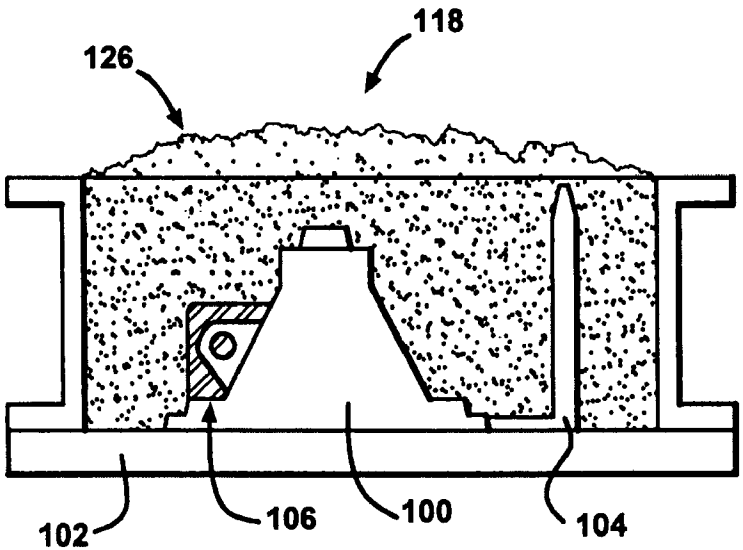
FIG. 5 is a schematic side view of the first flask filled with a conformable material.

FIGS. 5 and 6 depict a conformable, heat-resistant material, such as sand 126, located in the first flask 118 and second flask 124. The sand 126 may be located in the flasks 118, 124 by manual or automated means as known by those skilled in the art. One or more binder materials (not shown) may be added to cause the sand 126 to stick together.

Figure 8:
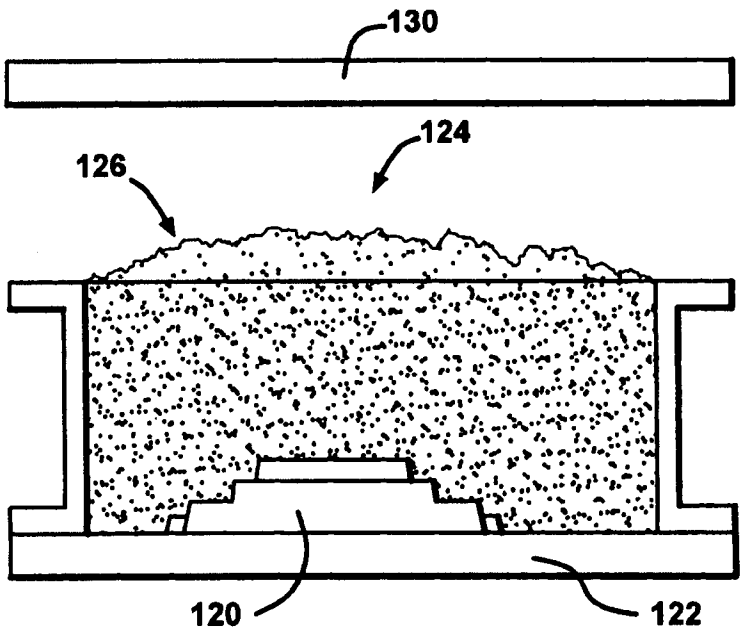
FIG. 8 schematically depicts a side view of a compressing means located over the second flask.
Figure 7:
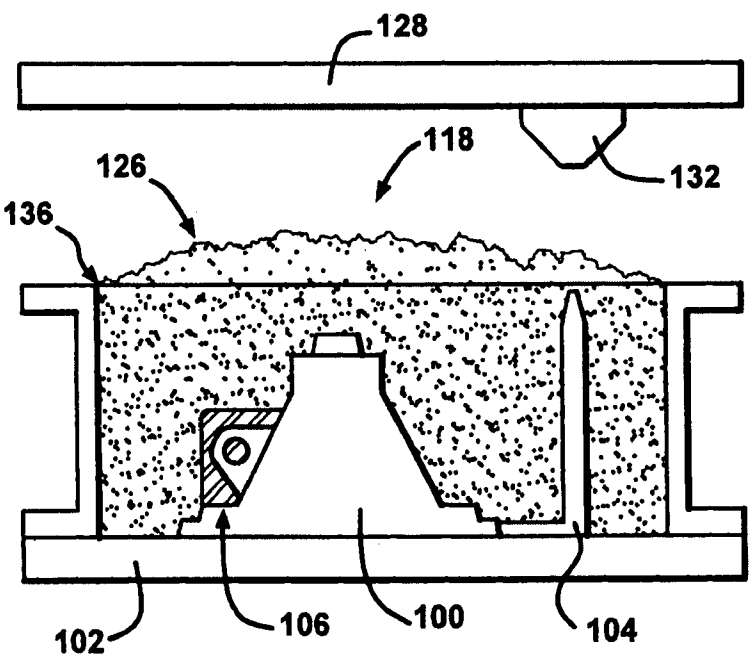
FIG. 7 schematically depicts a side view of a compressing means located over the first flask.

A first compacting structure 128 is positioned over the first flask 118 and a second compacting structure 130 is positioned over the second flask 124, as best seen in FIGS. 7 and 8, respectively. Preferably, the first compacting structure 128 has a portion 132 for creating a hollow portion within the sand 126. The portion 132 can be of any shape or size, but preferably it is designed to provide a passageway 134 from an upper surface 136 of the first flask 118 to the riser 104.

Figure 10:
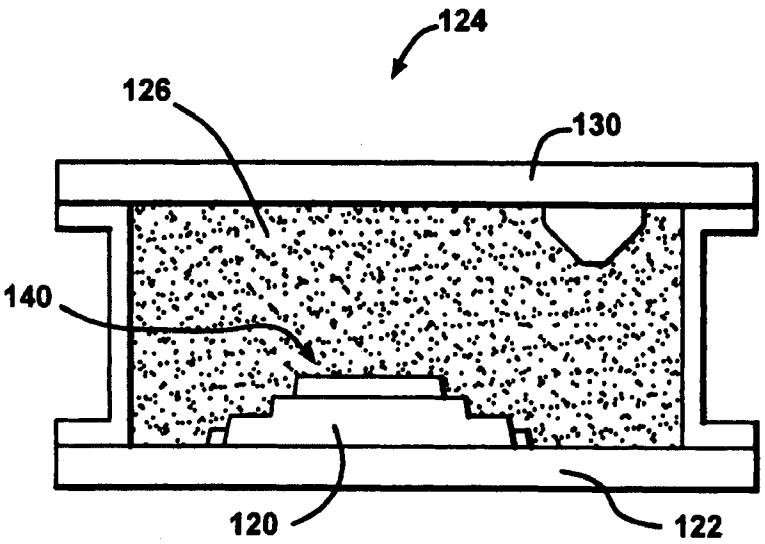
FIG. 10 schematically depicts a side view of the compressing means in contact with the second flask.
Figure 9:
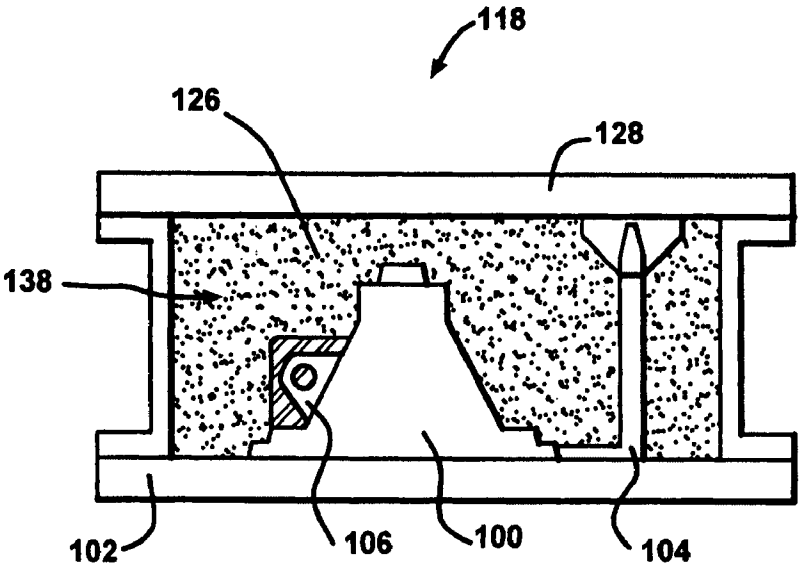
FIG. 9 schematically depicts a side view of the compressing means in contact with the first flask.
Figure 12:
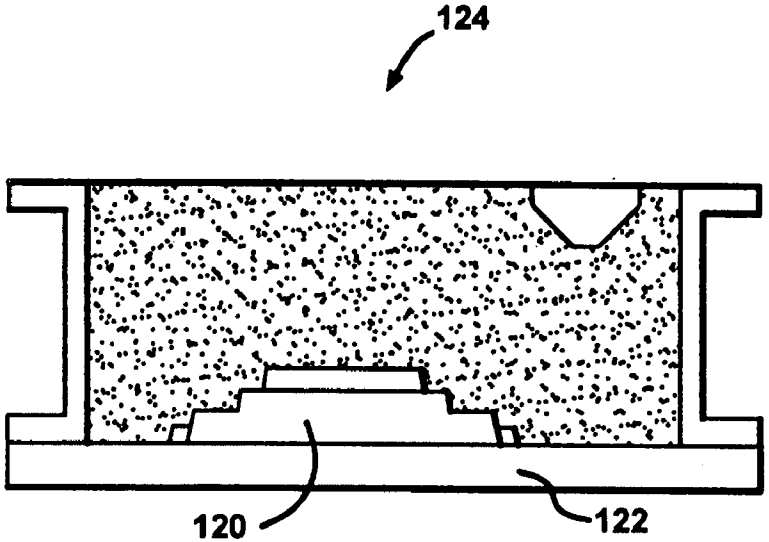
FIG. 12 schematically depicts a side view of the second flask with the compressing means removed.
Figure 11:
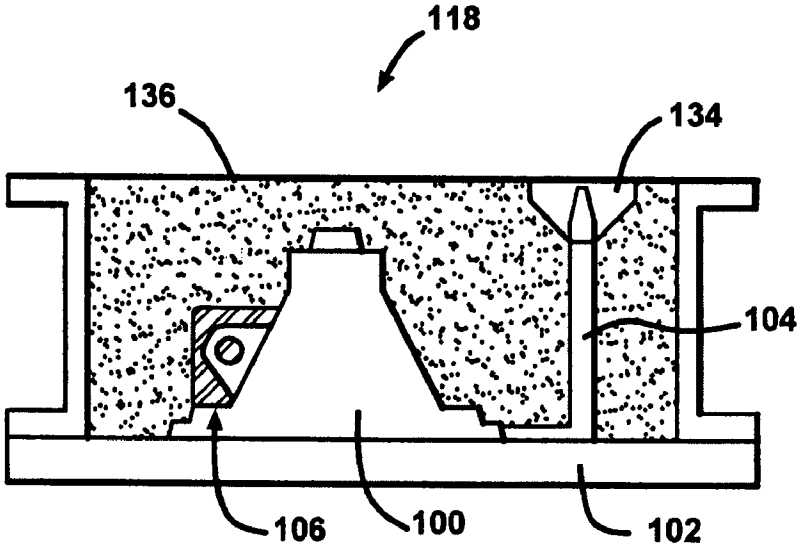
FIG. 11 schematically depicts a side view of the first flask with the compressing means removed.

The first and second compacting structures 128, 130 compress the sand 126 within the first and second flasks 118, 124, as shown in FIGS. 9 and 10. The compression creates a mold impression of the cope 100 in the sand 126 and a mold impression of the drag 120 in the sand 126. More specifically, the compression conforms the sand 126 into a first complementary shape 138 with the cope 100 and core 106 and a second complementary shape 140 with the drag 120. The first and second compacting structures 138, 140 are then removed from the first and second flasks 118, 124 by manual or automated means, as best seen in FIGS. 11 and 12. The passageway 134 from the upper surface 136 of the first flask 118 to the sprue 104 is now apparent.

Those skilled in the art will appreciate that other means to compress and/or harden the sand 126 within the first and second flasks 118, 124 are well within the scope of the present invention. By way of example only, such means to compress and/or harden may include, but are not limited to, using one or more hardening chemicals, baking the sand, not baking the sand, hot box processes, metallic mold processes, and/or ceramic mold processes.

Figure 13:
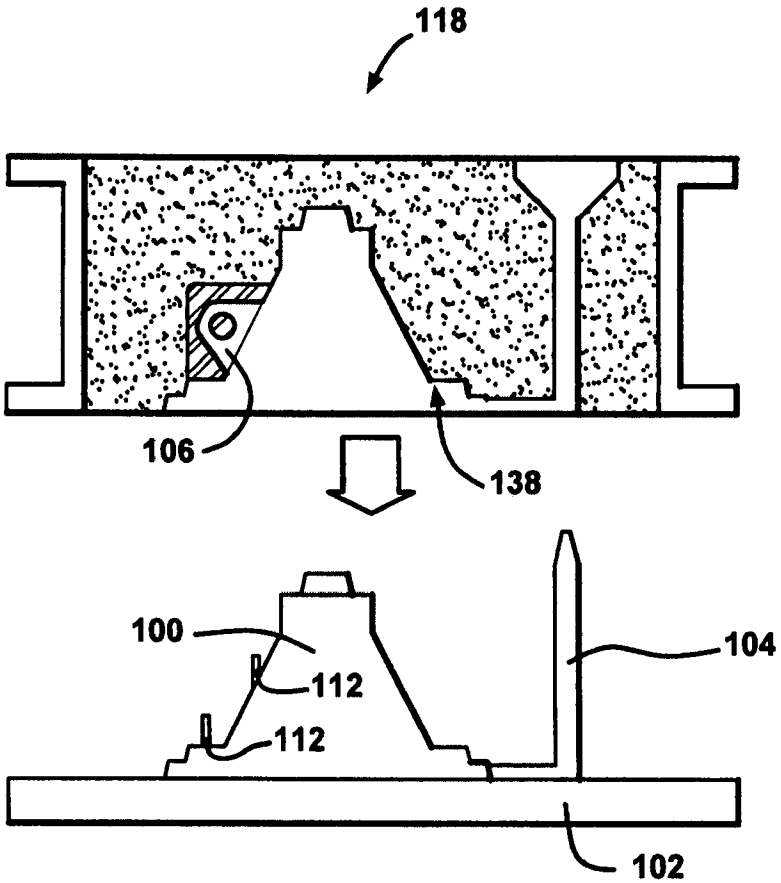
FIG. 13 schematically depicts a side view of the first flask removed from the first pattern.

FIG. 13 depicts the cope 100, base 102 and sprue 104 being removed from the first flask 118. Preferably, the cope 100, base 102 and sprue 104 are moved in a downward, vertical direction away from the first flask 118 so as to allow the core 106 to slide off the pins 112 on the cope 100. Those skilled in the art will appreciate that the cope 100, base 102 and sprue 104 can be removed from the first flask 118 in other directions depending on the orientation of the pins 112 on the cope 100 and the position of the core 106 on the cope 100. Those skilled in the art will also appreciate that if other structures or processes, such as mechanical fasteners, mechanical or fluid driven clamps, magnets and/or vacuum are used with, or instead of the pins 112, that they must release the core 106 from the cope 100.

Figure 14:
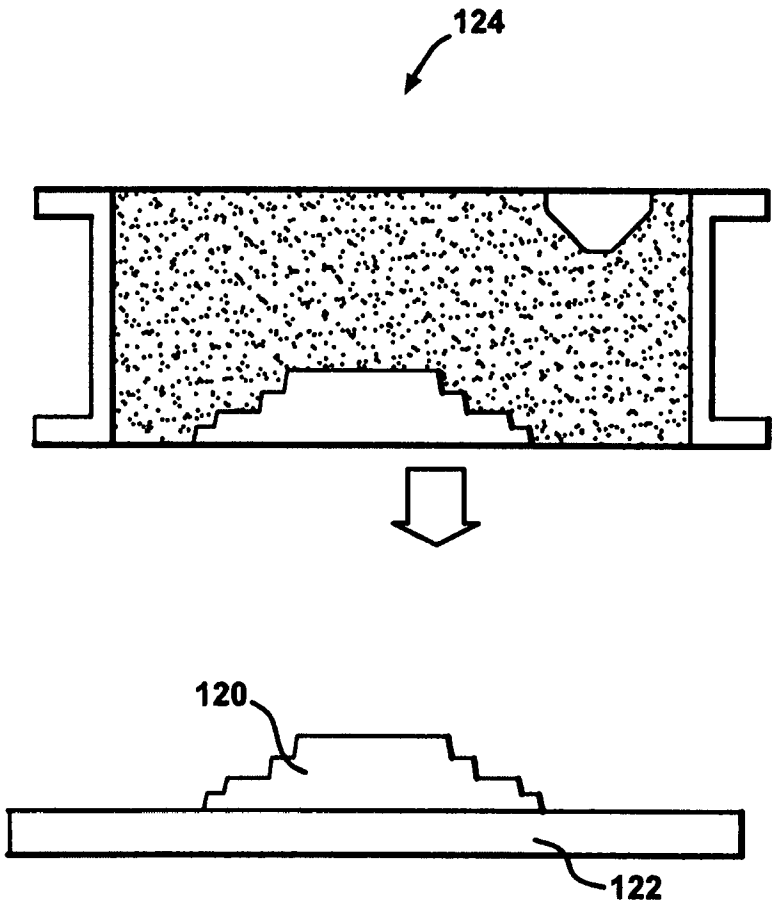
FIG. 14 schematically depicts a side view of the second flask removed from the second pattern.

The drag 120 is also removed from the second flask 124, as shown in FIG. 14. In the preferred embodiment, the drag 120 is moved in a vertical downward direction away from the second flask 124, however, depending on the orientation of the second flask 124, those skilled in the art will appreciate that the drag 120 may be moved away from the second flask 124 in other directions.

Figure 16:
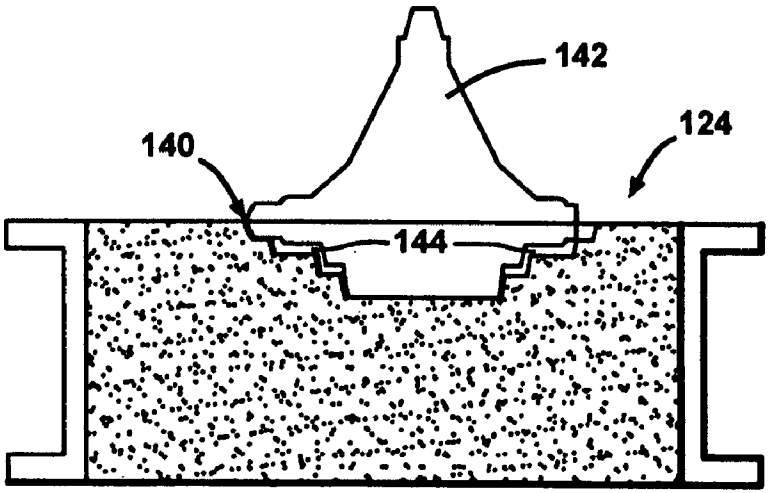
FIG. 16 schematically depicts a side view of the mold located in the second flask.
Figure 15:
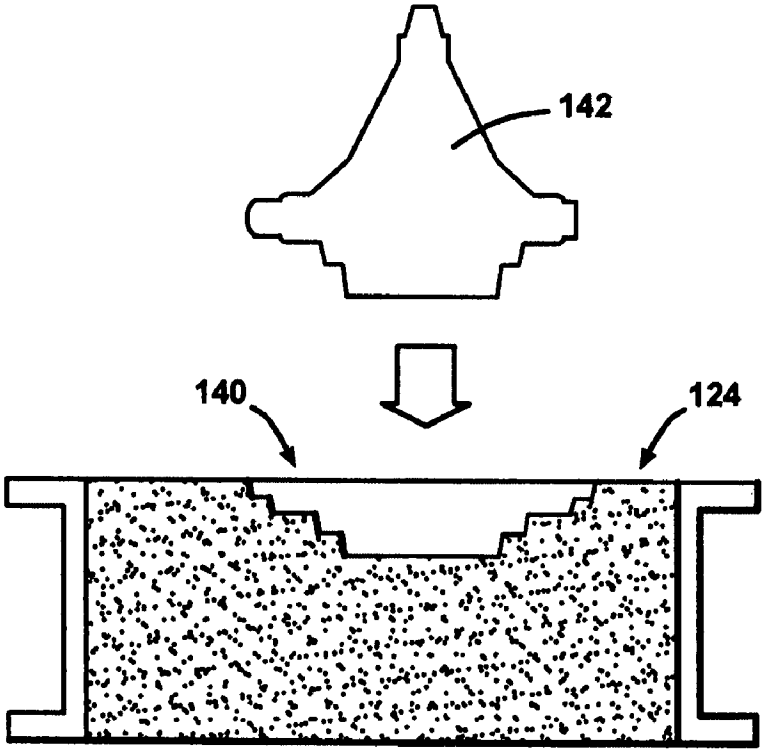
FIG. 15 schematically depicts a side view of a mold positioned above the second flask.

The second flask 124 is then rotated 180 degrees by manual or automated means. As shown in FIG. 15, a mold 142 is positioned over the second complementary shape 140 of the rotated second flask 124. The mold 142 is then located at least partially within the second complementary shape 140 by automated or manual means, as known to those skilled in the art. The mold 142 preferably has a similar shape to at least part of the second complementary shape 140. In the preferred embodiment, a space 144 exists between the mold 142 and the second complementary shape 140, as best seen in FIG. 16.

Those skilled in the art will appreciate that a mold may not even be required depending on the part to be cast and/or the complex shape to be formed.

Figure 18:
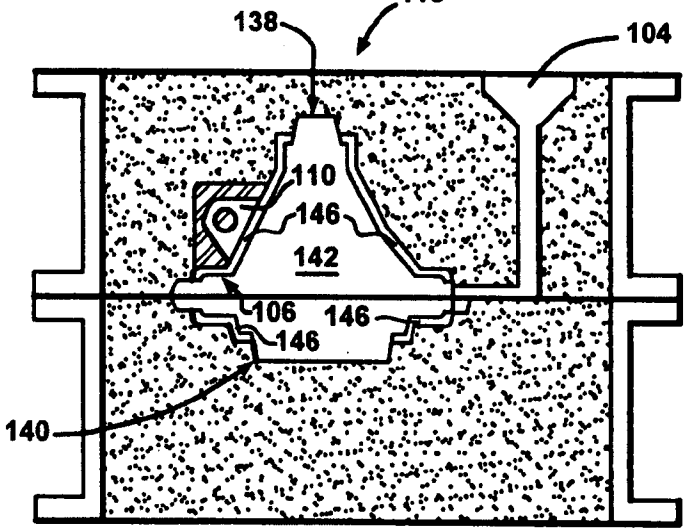
FIG. 18 schematically depicts a side view of the first flask adjacent the second flask.
Figure 17:
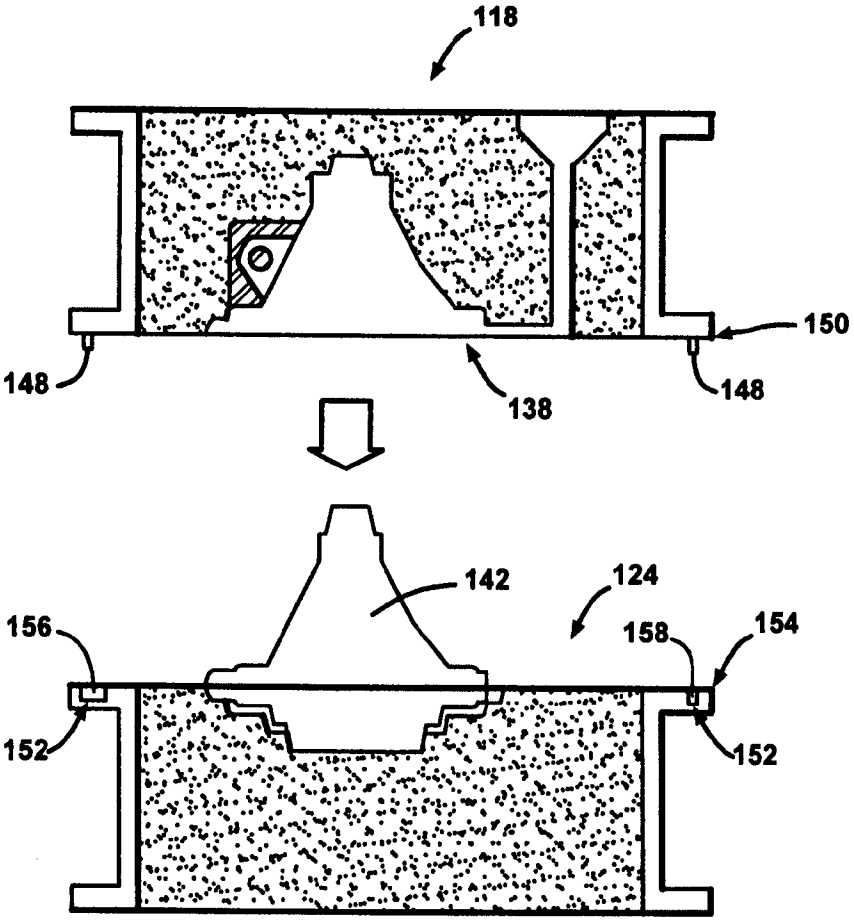
FIG. 17 schematically depicts a side view of the first flask located above the second flask.

FIG. 17 depicts the first flask 118, with the first complementary shape 138 therein, being positioned above the second flask 124 and the mold 142. The first flask 118 and the second flask 124 are brought together so that the mold 142 fits within the first complementary shape 138 of the first flask 118, as shown in FIG. 18, to form a single casting.

In the preferred embodiment depicted in the figures, a space 146 exists between the mold 142 and the first complementary shape 138. The hollow interior portion 110 of the core 106 is preferably in fluid communication with the space 146. The sprue 104 is in communication with the space 146 between the first complementary shape 138 and the mold 142 and the second complementary shape 140 and the mold 142. Those skilled in the art will appreciate that the core 106 can be in fluid communication directly with the sprue 104 or with any space 144, 146 in fluid communication with the sprue 104.

For the particular depicted embodiment, it is important to locate the first flask 118 and the first complementary shape 138 in a particular location with respect to the second flask 124 and the second complementary shape 140 to align the spaces 144, 146 within the first flask 118 and the second flask 124 and to ensure the spaces 144, 146 have a uniform thickness, if uniform wall thickness of the cast part is desired. Those skilled in the art will appreciate that other castings may, or may not, require the spaces 144, 146, if any, to be aligned depending on the shape and the design of the part to be cast.

Referring back to FIG. 17, it is preferred that at least two guide pins 148 located on a perimeter portion 150 of the first flask 118 are aligned with, and are inserted into, recesses 152 within a perimeter portion 154 of the second flask 124. In a more preferred embodiment, one of the recesses 154 has an oval shape. The oval shape allows one of the guide pins 148 to be initially slightly out of alignment with the recess 156, but still be inserted. Locating at least one of the guide pins 148 within the recess 156 facilitates aligning the other guide pins 148 and recesses 152.

The other recess 158 is circular in shape. The guide pin 148 must be precisely aligned with the circular recess 158 to be inserted. Those skilled in the art will appreciate that the guide pins 148 can be located on the second flask 124 and the recesses 152 on the first flask 118 without departing from the scope of the present invention. Other alignment means may also be employed to align the first and second flasks 118, 124 without departing from the scope of the present invention.

Those skilled in the art will appreciate that if a second flask 124 is not required for a particular part, the above step is not required.

Figure 20:
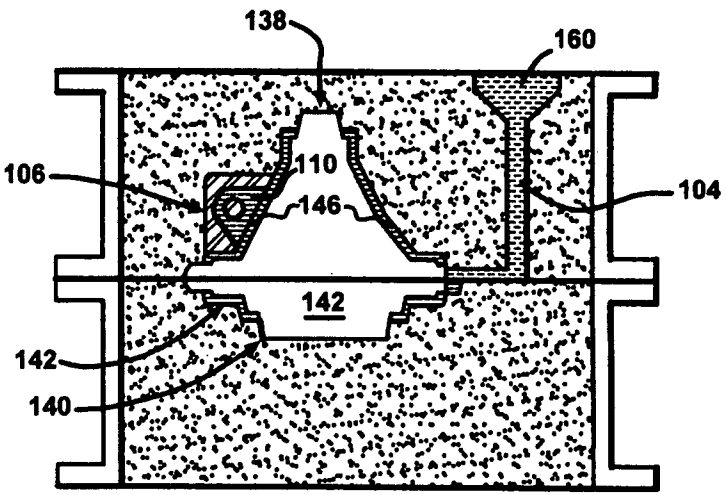
FIG. 20 schematically depicts a side view of the hardenable material within the first and second flasks.
Figure 19:
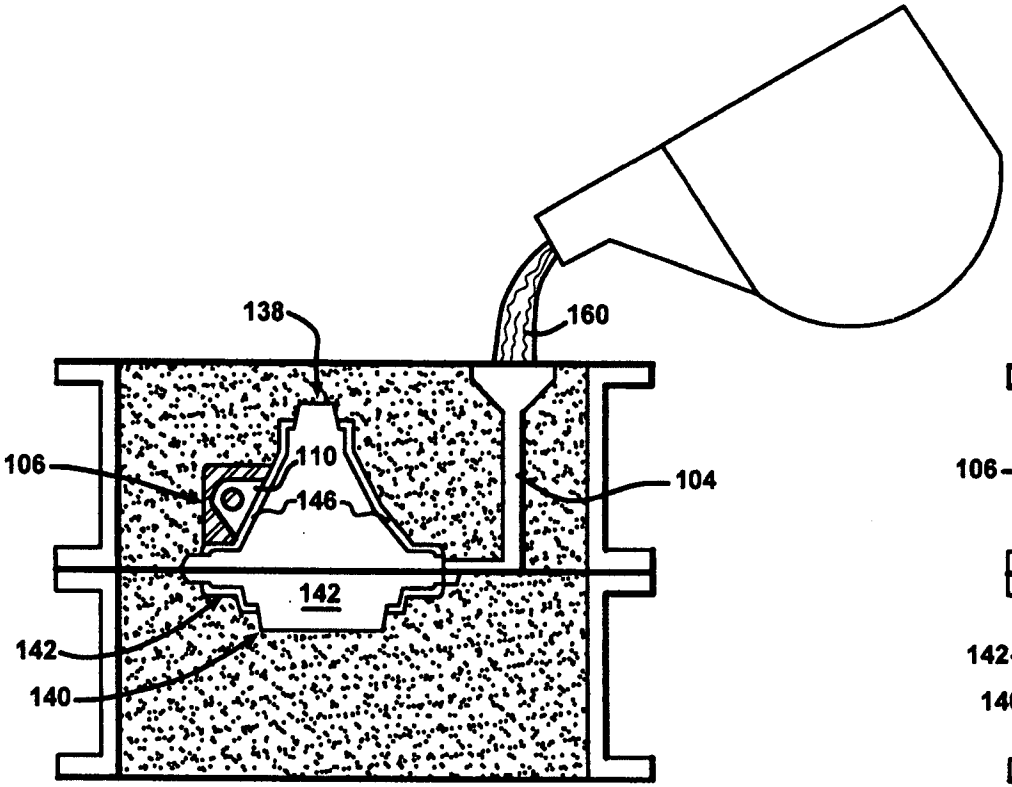
FIG. 19 schematically depicts a side view of hardenable material being located into the first and second flasks.

A hardenable material, such as molten metal 160, is poured into the sprue 104, as seen in FIG. 19. The molten metal 160 flows through, and fills, the space 146 between the first complementary shape 138 and the mold 142, into the hollow interior portion 110 of the core 106, and in the space 144 between the second complementary shape 140 and the mold 142, as depicted in FIG. 20. In the preferred embodiment, the core 106 retains its shape, position and design at least during the introduction of the molten metal 160.

Figure 22:
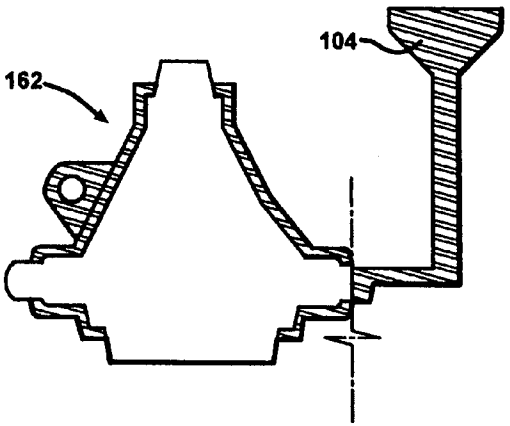
FIG. 22 schematically depicts a side view of one embodiment of a cast part with a pouring system attached and showing a complex shape attached to the part.
Figure 21:
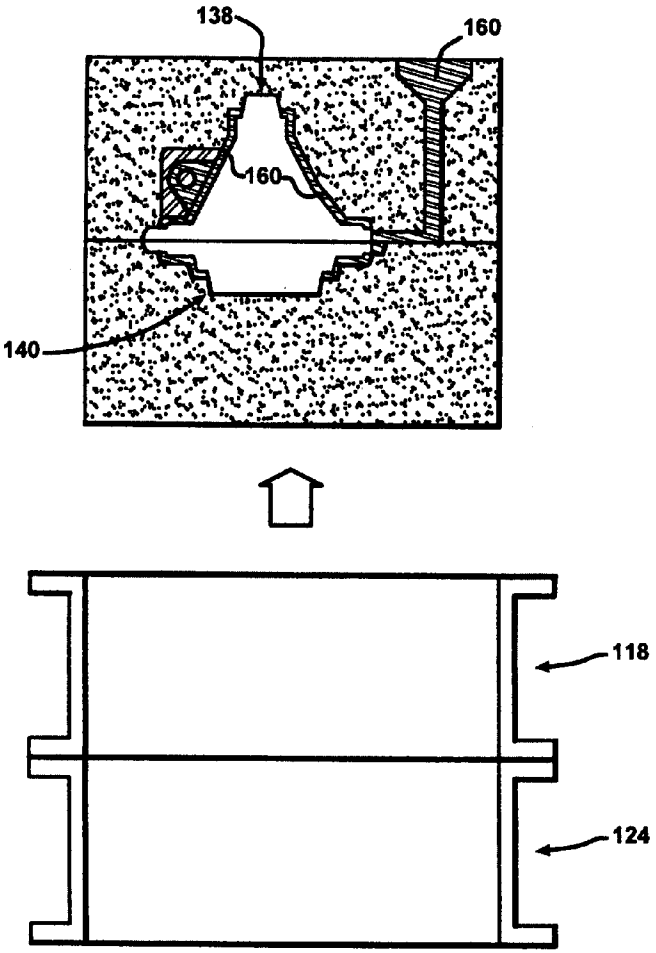
FIG. 21 schematically depicts a side view of at least one sand core being removed from the first and second flasks.

The first and second complementary shapes 138, 140 are then removed from the first and second flasks 118, 124 when the molten metal 160 is hardened, as seen in FIG. 21. The first and second complementary shapes 138, 140 are preferably removed with an automated mechanism which pushes them out of the flasks 118, 124, respectively. The first and second complementary shapes 138, 140 are removed from a cast part 162 by means known to those skilled in the art leaving behind the part 162 and the sprue 104, as depicted in FIG. 22. The riser 104 is removed from the part 162 by known means.

In the preferred embodiment described herein, the core 106 is removed from the cast part 162 to leave behind a complementary shaped part 162, or portion of the part 162. Typically, this requires the destruction of the core 106, although cores that can be removed from the cast part 162 without being destroyed are well within the scope of the present invention. Reusable cores 106 are also within the scope of the present invention.

Figure 23:
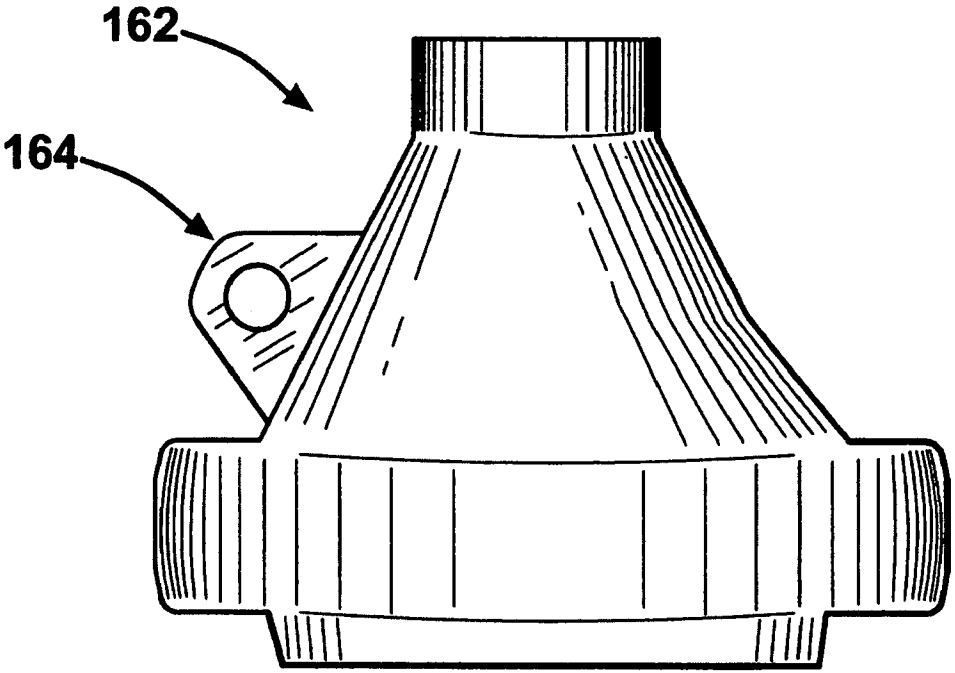
FIG. 23 schematically depicts a side view of the cast part.

The cast part 162 is depicted in FIG. 23 having the riser 104 removed and a cast on portion 164 from the core 106 integrally formed with the part 162.

The embodiment of the invention described above is illustrative of only a single apparatus and process. Those skilled in the art will readily appreciate that the present invention can be used with any parting line apparatus and processes as known to those skilled in the art.

In accordance with the provisions of the patent statutes, the present invention has been described in what is considered to represent its preferred embodiments. However, it should be noted that the invention can be practiced otherwise than as specifically illustrated and described without departing from its spirit or scope.

What is claimed is:

1. An article casting process, comprising:

providing at least one pattern;

securing at least one core to said at least one pattern;

providing a conformable material about said at least one core and said at least one pattern to form said conformable material into at least one complementary shaped structure to said core and said pattern;

removing said at least one pattern from said conformable material and leaving said at least one core at least partially in said conformable material;

locating at least one mold adjacent said complementary shaped structure;

locating a hardenable material between said at least one mold and said complementary shaped structure, and into at least a portion of said core, to form a part; and allowing said hardenable material to solidify and then removing said part from said mold and said core, said part having a structure with a complementary shape to said core integrally formed therewith.

2. The process of claim 1, wherein said pattern has a cope portion and a drag portion.

3. The process of claim 2, wherein said core is secured to said cope portion with at least one pin and wherein said at least one pin permits said core to be moved vertically with respect to said cope portion but said pin resists horizontal movement of said core with respect to said cope portion.

4. The process of claim 3, wherein said core defines a complex shape to be integrally formed with said part.

5. The process of claim 4, wherein said cope portion, with said core secured thereto, is located within a first flask and said drag portion is located within a second flask.

6. The process of claim 5, wherein said first flask is filled with said conformable material and said second flask is filled with said conformable material and said conformable material in both said flasks is compressed.

7. The process of claim 6, wherein said cope portion is removed from said conformable material allowing said core to slide off said at least one pin and remain within said conformable material.

8. The process of claim 7, wherein said hardenable material is a molten metal located within said core and one or more passageways between said mold and said conformable material of said first flask and said second flask.

9. The process of claim 8, wherein said core retains its shape when said molten metal is located therein.

10. An article casting process, comprising:

providing at least one core removably secured to at least one pattern;

creating a sand mold having a complementary shape to said pattern and said core;

removing said pattern from said sand mold and leaving said core within said sand mold;

locating at least one temporary mold within said sand mold and adjacent said core;

locating a molten metal between said at least one temporary mold and said sand mold and into said core to form a part having a complementary shape to said temporary mold, said sand mold and said core; and allowing said molten material to harden and then removing said part from said temporary mold, said sand mold and said core.

11. The process of claim 10, wherein said core is secured to said pattern with at least one pin.

12. The process of claim 11, wherein said at least one pin permits said core to be moved vertically with respect to said pattern but said pin resists horizontal movement of said core with respect to said pattern.

13. The process of claim 12, wherein said pattern comprises a cope portion and a drag portion.

14. The process of claim 13, wherein said cope portion is located within a first flask and said drag portion is located within a second flask.

15. The process of claim 14, wherein said first flask is filled with sand and said second flask is filled with sand and said sand in both of said flasks is compressed.

16. The process of claim 15, wherein said cope portion is removed from said sand allowing said core to slide off said at least one pin and remain within said sand.

17. The process of claim 16, wherein core defines a complex shape to be integrally formed with said part.

18. The process of claim 17, wherein molten metal is located in at least one passageway within said core and one or more passageways between said temporary mold and said sand of said first flask and said second flask.

19. The process of claim 18, wherein said core retains its shape when said molten metal is located therein.

20. An article casting process, comprising;

providing at least one core having a complexly shaped interior portion removably secured to at least one pattern;

creating a sand mold having a complementary shape to said pattern and said core;

removing said pattern from said sand mold and leaving said core within said sand mold;

locating a molten metal at least into said complexly shaped interior portion of said core and within said sand mold to form a part with an integrally formed complex shape complementary to at least a portion of said interior portion of said core; and allowing said molten material to harden and then removing said sand mold and said core from said part.

* * * * *